US009388596B2

(12) United States Patent
Hanan et al.

(10) Patent No.: US 9,388,596 B2
(45) Date of Patent: Jul. 12, 2016

(54) POOL CLEANING VEHICLE WITH MECHANISM FOR SKEWING AN AXLE

(71) Applicant: Aqua Products, Inc., Cedar Grove, NJ (US)

(72) Inventors: Ethan Hanan, Teaneck, NJ (US); Kameshwar Durvasula, Garfield, NJ (US); William Londono Correa, Bloomfield, NJ (US); Aleksandr Klebanov, Bloomfield, NJ (US); Jason Zerweck, Media, PA (US); Tony Gatta, Longano (IT)

(73) Assignee: Aqua Products, Inc., Cedar Grove, NJ (US)

( * ) Notice: Subject to any disclaimer, the term of this patent is extended or adjusted under 35 U.S.C. 154(b) by 0 days.

(21) Appl. No.: 14/748,018

(22) Filed: Jun. 23, 2015

(65) Prior Publication Data

US 2015/0322685 A1 Nov. 12, 2015

Related U.S. Application Data

(62) Division of application No. 13/681,918, filed on Nov. 20, 2012, now Pat. No. 9,074,385.

(51) Int. Cl.
*E04H 4/16* (2006.01)

(52) U.S. Cl.
CPC ..... *E04H 4/1654* (2013.01)

(58) Field of Classification Search
CPC ..... E04H 4/1654; E04H 4/1663
See application file for complete search history.

(56) References Cited

U.S. PATENT DOCUMENTS 3,069,182 A 12/1962 Hufford
3,662,848 A 5/1972 Magnusson
5,337,434 A * 8/1994 Erlich ..... E04H 4/1654 15/1.7
5,351,355 A * 10/1994 Chiniara ..... E04H 4/1654 15/1.7
5,617,600 A 4/1997 Frantini
6,412,133 B1 * 7/2002 Erlich ..... E04H 4/1654 15/1.7
6,742,613 B2 6/2004 Erlich
6,782,578 B1 8/2004 Rief
7,213,287 B2 5/2007 Hui
8,307,485 B2 * 11/2012 Sumonthee ..... E04H 4/1654 15/1.7
8,752,226 B2 6/2014 Erlich
8,869,337 B2 * 10/2014 Sumonthee ..... E04H 4/1654 15/1.7
2003/0077979 A1 4/2003 Hoeting
2003/0201218 A1 10/2003 Henkin
2007/0157413 A1 7/2007 Rommagnac
2008/0092322 A1 4/2008 Halle
2008/0168610 A1 7/2008 Halle
2009/0300862 A1 12/2009 Schneider
2013/0133144 A1 5/2013 Erlich
2013/0146106 A1 6/2013 Erlich
2013/0269729 A1 10/2013 Erlich
2015/0197951 A1 7/2015 Erlich

* cited by examiner

*Primary Examiner* — Dung Van Nguyen
(74) *Attorney, Agent, or Firm* — Abelman, Frayne & Schwab

(57) ABSTRACT

A self directed pool cleaning vehicle comprising a body carrying water inlet and outlet ports with the inlet port being located on the bottom of the body with the body containing a filter is described. A drive mechanism propels the vehicle in two generally opposed directions. Two axles which each carry two wheels support the body and control its direction of movement. One axle is mounted to the body via slots that extend in the directions of motion such that this axle can move toward either end of the slots. A steering structure is provided with a portion that moves to close a portion of one of the slots and can be locked in a position that prevents one end of an axle from traversing its slot. Thus when this axle is the trialing axle it is held at other than a right angle to the two generally opposed directions.

13 Claims, 18 Drawing Sheets

POOL CLEANING VEHICLE WITH MECHANISM FOR SKEWING AN AXLE

CROSS REFERENCE TO RELATED APPLICATIONS

This patent application is a divisional of U.S. patent application Ser. No. 13/681,918, filed Nov. 20, 2012, the content of which is incorporated by reference herein in its entirety.

BACKGROUND

There are robotic cleaning vehicles which traverse the bottom of swimming pools and other large liquid containers submerged in the contained liquid. The robotic cleaning vehicle draws in liquid from ports in their bottom and passing the liquid through filters in the body of the vehicle and expels the filtered liquid back into the large container, typically a swimming pool. These vehicles typically travel on wheels which suspend the body of the vehicle above the bottom of the container. In some cases these wheels are mounted on axles and one of the axles is held at angle other than perpendicular to the general direction of movement of the vehicle so that as the vehicle moves forward and back on its wheels it follows a path that covers a significant portion of the container.

SUMMARY

A self directed pool cleaning vehicle comprising a body includes a water inlet port and a water outlet port with the inlet port being located on the bottom of the body and containing a filter. A drive mechanism mounted to the body propels the vehicle in two generally opposed directions. A first axle and a second axle, with each axle carrying two wheels at either end, support the body and control its direction of movement in response to the drive mechanism. The axles are mounted to the body such that they can be generally perpendicular to the directions in which the drive mechanism propels the vehicle. The first axle is mounted to the body via a first slot and a second slot, with each slot extending generally in the direction in which the drive mechanism propels the vehicle such that the first axle can move toward either end of the slots. A steering structure is provided having a flexible member with at least a first portion which moves to close a portion of the first slot to limit the movement of the first axle in the first slot, the movement of the first portion changing the angle of the first axle to other than perpendicular to the directions in which the drive mechanism propels the vehicle when the first axle is used as the trailing axle. The steering structure has a locking mechanism which interacts with the body to hold the first portion in a position closing a portion of its slot.

DETAILED DESCRIPTION

Figure 1:
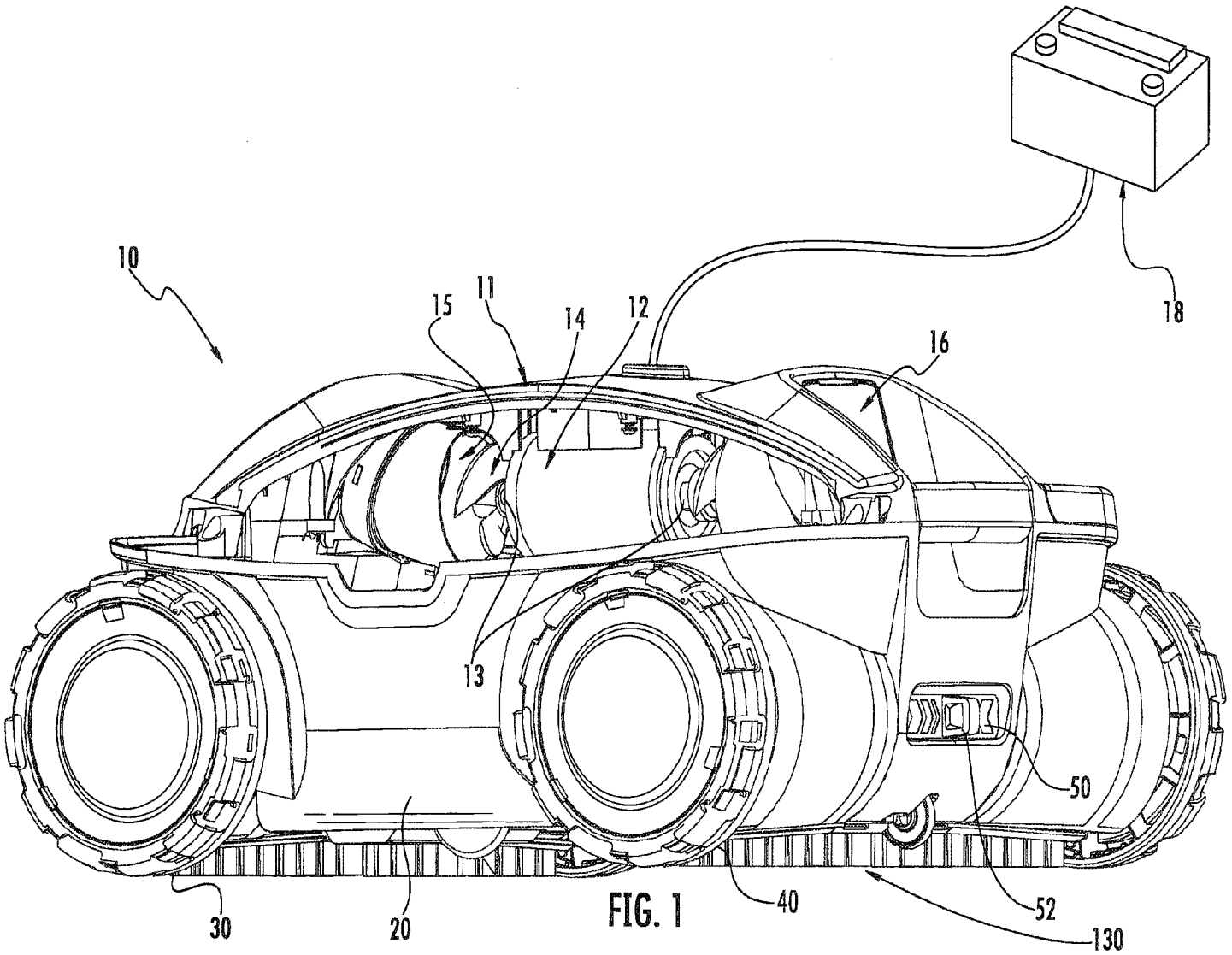
FIG. 1 is a perspective view of a self directed cleaning vehicle which is an embodiment of the present invention with its remote power supply.

Referring to FIG. 1 a self directed vehicle 10 has a body with a top bridge 11 to which is mounted an electric motor 12 with a shaft 13 projecting out of each end of motor 12. In an alternative embodiment shaft 13 is two separate shafts, with each separate shaft extending from an opposing end of motor 12. Attached to each end of the shaft 13 is a propeller 14 which faces an outlet port 15. Each outlet port is covered with a flap valve 16 hinged to allow the expulsion of water from the vehicle but to prevent its ingress. The electric motor 12 has an external source of power 18 which includes a timing mechanism to reverse the direction of the rotation of the motor 12. The vehicle 10 also has a chassis or bottom body 20 which is supported by and travels on front wheels 30 and rear wheels 40. The rear wheels 40 are associated with a steering structure including a steering ribbon or flexible member 50 which is operated by a slide knob 52. The front wheels 30 are carried by an axle (not shown) which is fixed in its orientation to the chassis 20.

The rear wheels 40 are carried by an axle 80 (Shown in FIGS. 2, 7 and 16) which is able to slide in slots 90 (Shown in FIGS. 2-4, 6-7 and 16). A steering ribbon 50 is adjusted to partially block one of these slots from its rear edge. Thus when the axle 80 is the trailing axle (That is the vehicle moving away the ribbon 50), one end of the axle 80 cannot move to the rear of its slot and the axle 80 assumes a skewed configuration (Shown in FIG. 16).

Figure 2:
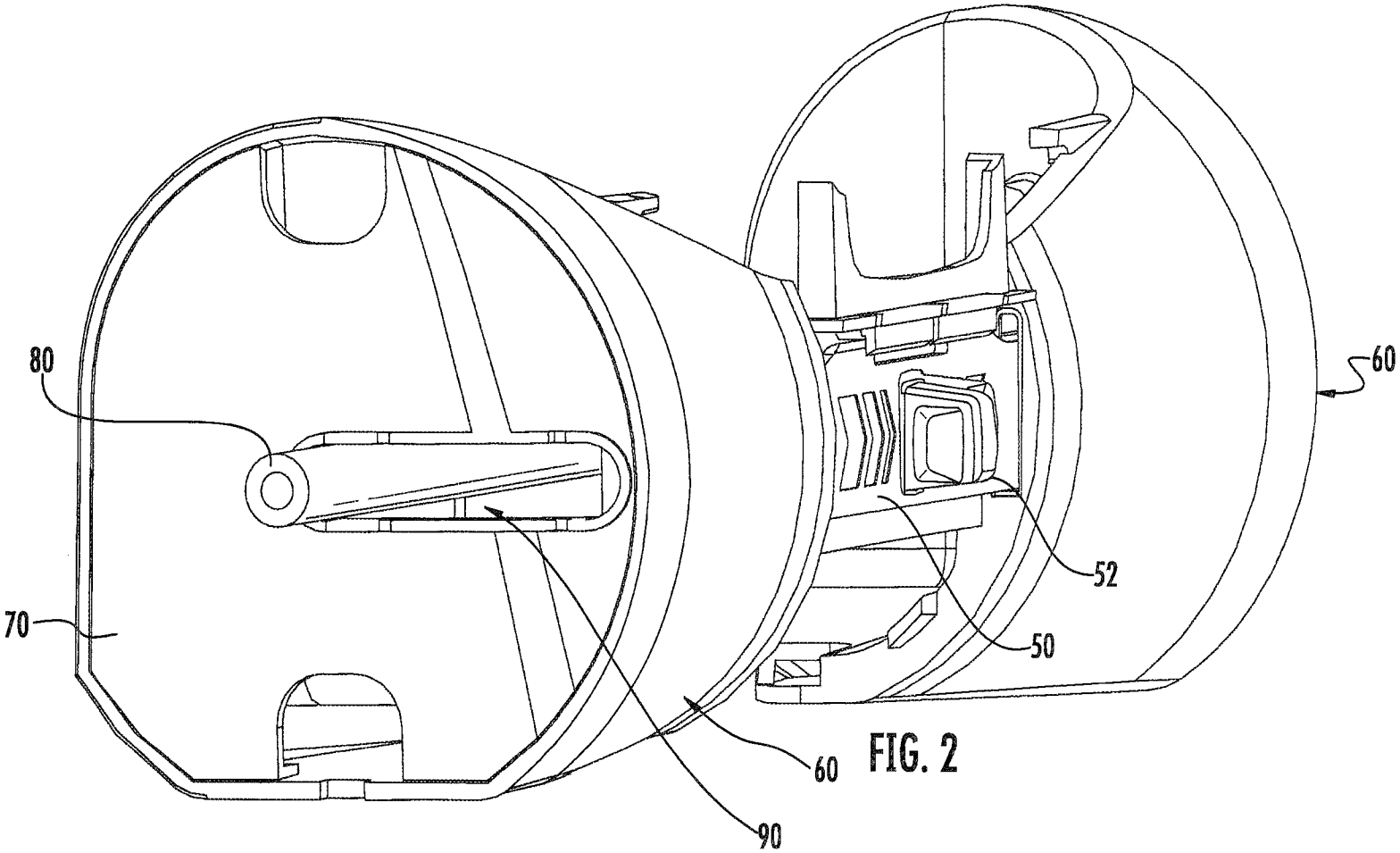
FIG. 2 is a perspective view of the rear axle and associated elements of the vehicle of FIG. 1.

FIG. 2 shows details of how the wheel wells 60 of the vehicle carry the wheel well caps 70 which in turn carry the slots 90 in which is mounted the rear axle 80. It also shows the steering ribbon 50 with its slide knob 52 being guided and supported by the wells 60 and the caps 70.

Figure 3:
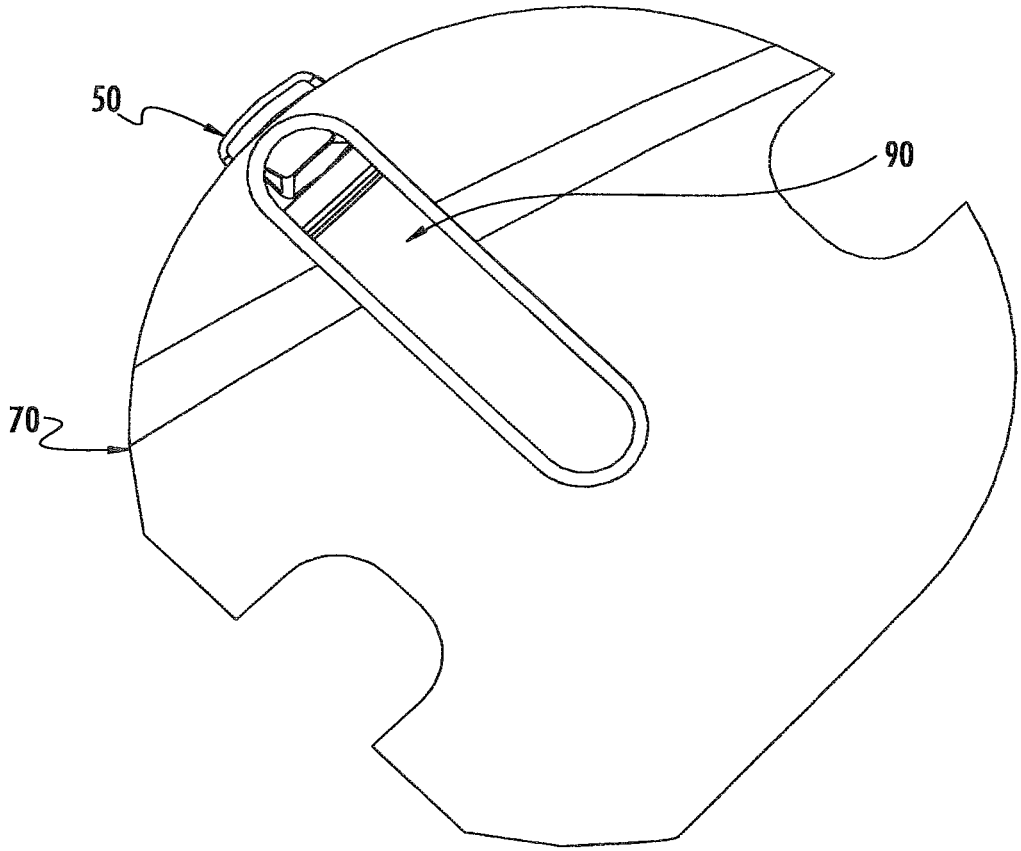
FIG. 3 is a side elevation of one of the mounting slots of the rear axle with the steering ribbon unengaged.
Figure 4:
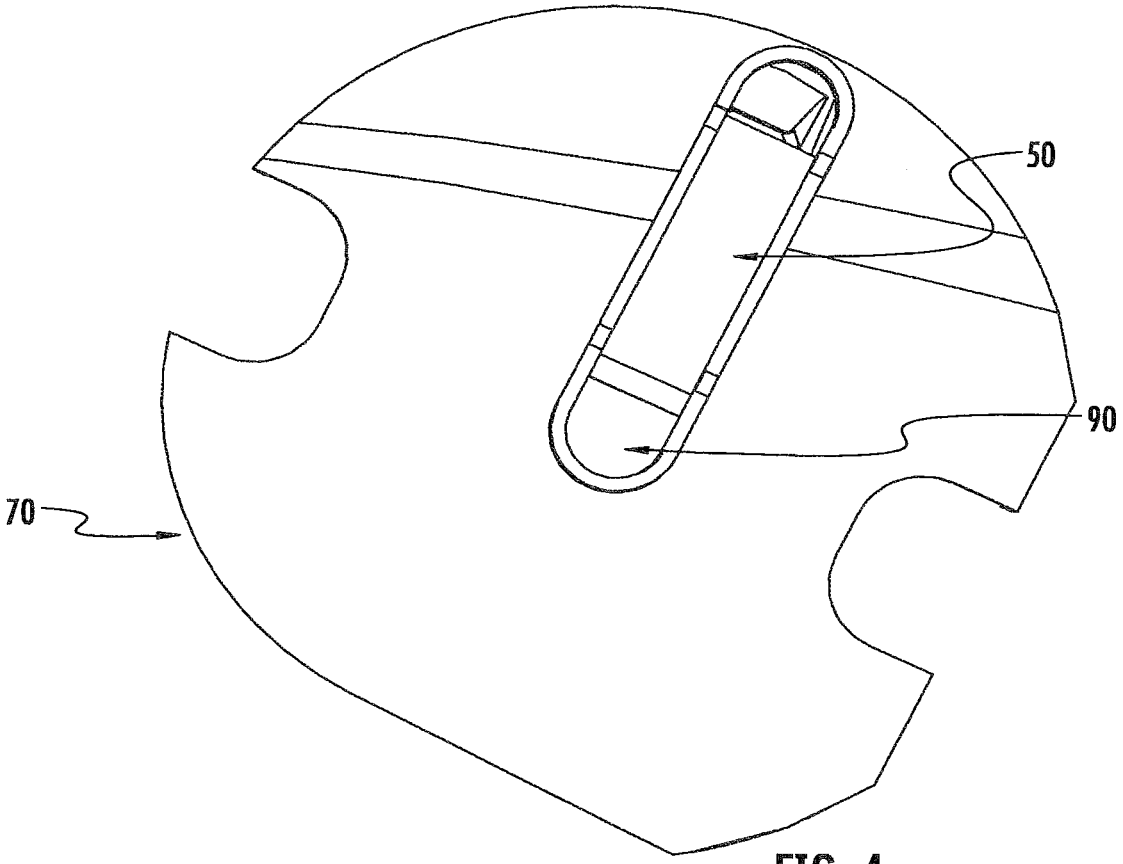
FIG. 4 is a side elevation of one of the mounting slots of the rear axle with the steering ribbon engaged.
Figure 5:
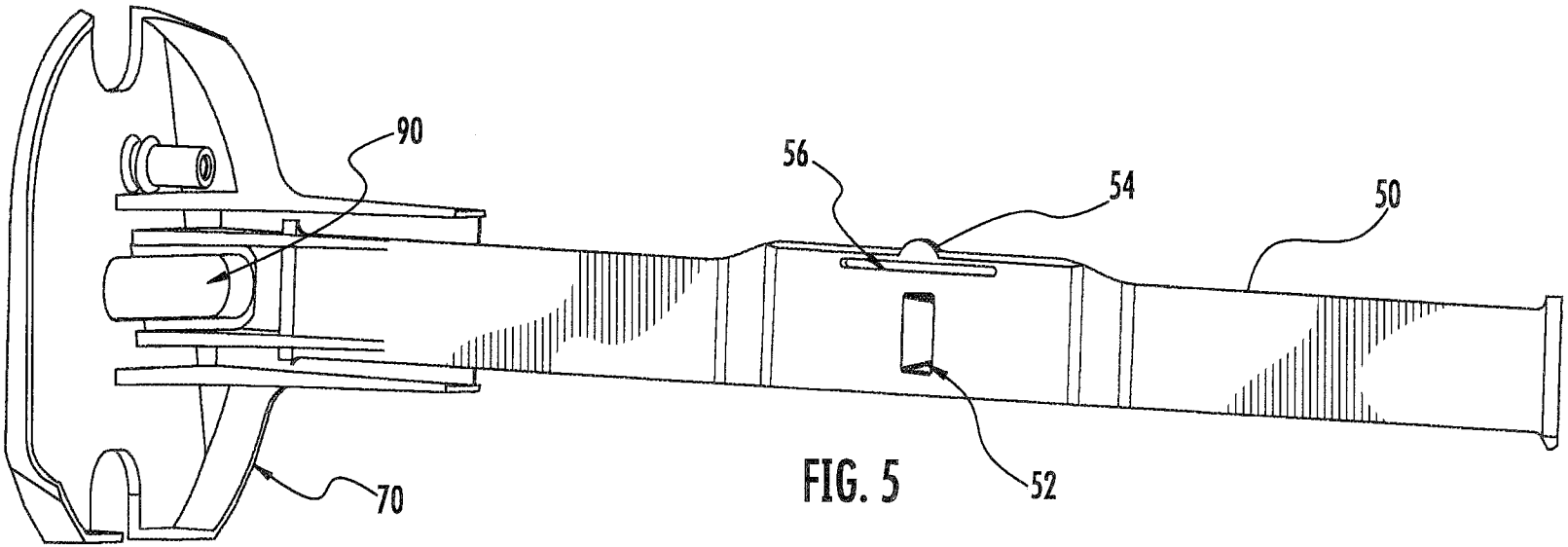
FIG. 5 is a perspective view of the steering ribbon and the wheel well cap that carries an axle mounting slot with the steering ribbon unengaged.
Figure 6:
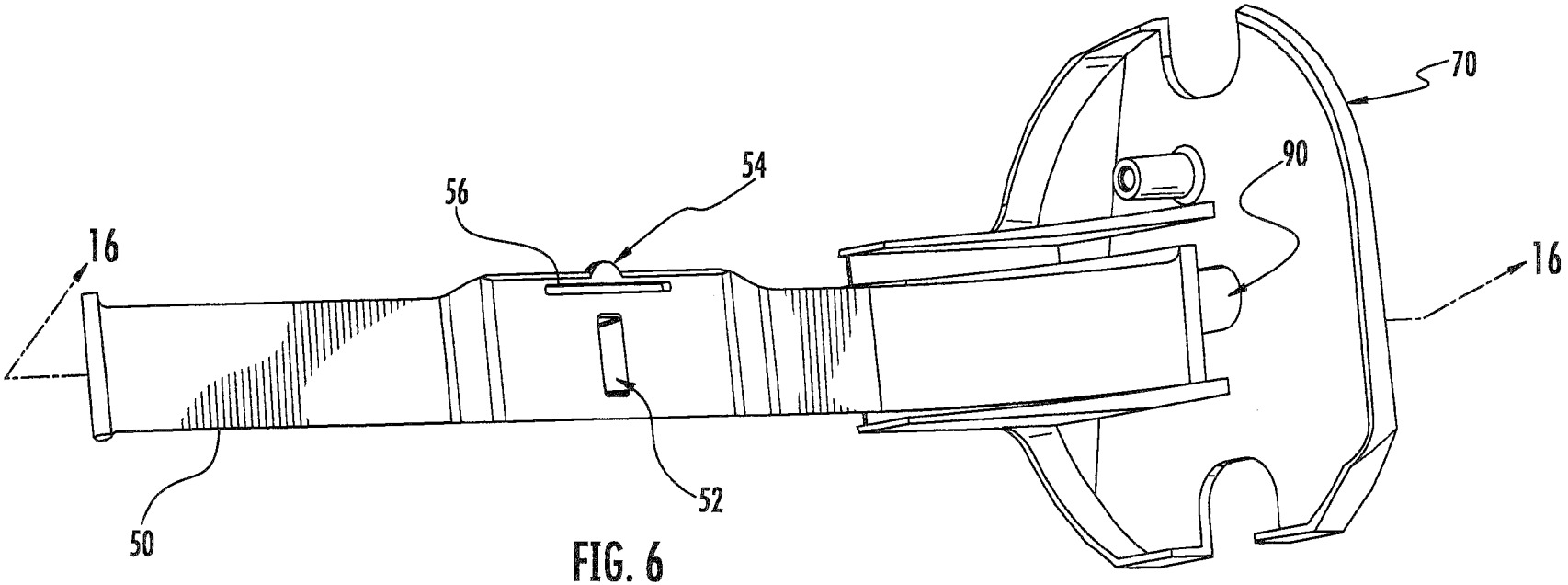
FIG. 6 is a perspective view of the steering ribbon and the wheel well cap that carries an axle mounting slot with the steering ribbon engaged.

FIG. 3 shows a wheel well cap 70 with its slot 90 unobscured by the steering ribbon 50 while FIG. 4 shows a similar view in which this slot has been obscured by the steering ribbon 50. FIG. 6 provides another view of a slot 90 being partially obscured by the steering ribbon 50. The steering ribbon slide knob 52, by which the position of the steering ribbon can be adjusted, is shown as well as the steering ribbon locking protrusion which interacts with other portions of the vehicle to hold the steering ribbon 50 in a given position. Slide knob 52 may be accessed from outside the body of the vehicle. Below the protrusion 54 is a slit 56 which allows the steering ribbon 50 to flex as the protrusion is moved from one locking position to another. Slit 56 provides a springing effect to locate protrusion 54 within locking slots 102 (Shown in FIG. 7). FIG. 5 provides a view similar to that of FIG. 6 in which the steering ribbon 50 is in a non-obscuring position.

Figure 7:
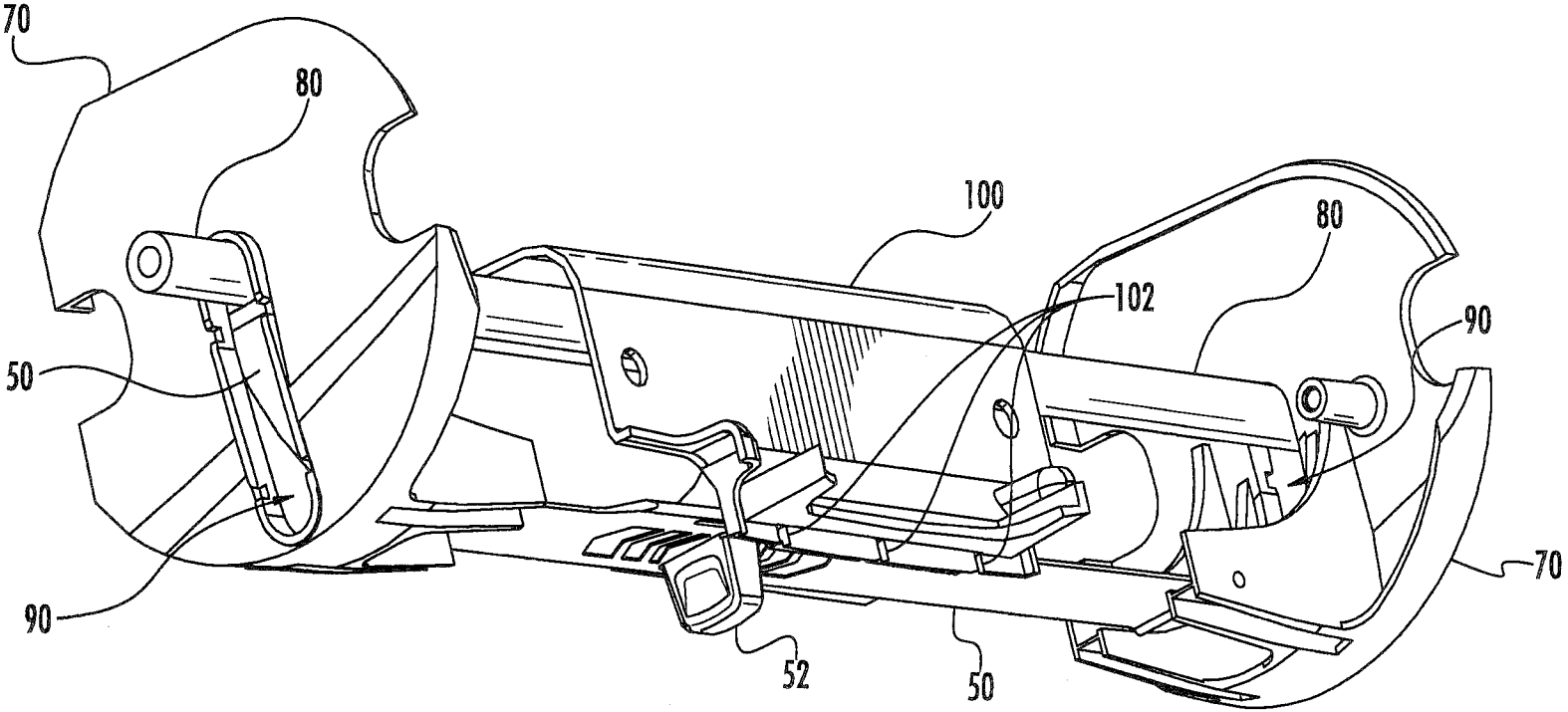
FIG. 7 is a perspective view of entire the steering ribbon assembly including both axle mounting slots and the locking mechanism.

FIG. 7 shows how the steering ribbon 50 interacts with other parts of the vehicle 10 to cause the back axle to become tilted when it is the trailing axle, i.e. when the vehicle is moving in a direction away from the steering ribbon. The right and left ends of the back axle 80 are each mounted in a slot 90. The right end is free to traverse the length of its slot 90 but the steering ribbon 50 has been positioned to hold the left end at the forward end of its slot 90. The chassis 20 of the vehicle 10 carries a steering ribbon locking bracket which in turn carries locking slots 102. These interact with the steering ribbon protrusion 54 shown in FIGS. 5 & 6 to lock the steering ribbon 50 in various positions. In this case the ribbon has been locked in a position such that it occludes most of the left slot 90. This occlusion can also be seen in FIG. 6. The slide knob 52 is used to move the steering ribbon 50 between the lock positions established by the steering ribbon locking slots 102 and the steering ribbon slit 56 and the steering ribbon protrusion 54 (Both shown in FIGS. 5 & 6) work together to allow the shift between locking positions. The slit 56 allows the protrusion 54 to move downward out of a locking slot 102 as the steering ribbon 50 is moved to the left or right by exerting pressure on the slide knob 52, which is itself readily accessible from the exterior of the vehicle as can be seen in FIG. 1. The movement of the steering ribbon 50 is constrained by the ribbon guide track 58 which can be seen in FIG. 16. The flexible nature of steering ribbon 50 permits at least the end portions of steering ribbon 50 to flex to be maintained within the non linear portions of guide track 58 as the ribbon 50 is moved within the track.

The vehicle 10 is propelled forward and backwards on its front wheels 30 and back wheels 40 by the operation of the electric motor 12 and its associated propellers 14 expelling water out of one of its outlet ports 15. The direction of rotation of the electric motor 12 is reversed by its remote power source 18 causing the direction of water expulsion and the direction of travel of the vehicle to be reversed. The power source 18 is conveniently equipped with a timer which causes the reversal and the timer is conveniently set to the time it takes the vehicle to traverse a length or width of the surface being cleaned. Thus as the vehicle reaches an end of this surface, the timer of the power source 18 acts to reverse its general direction of travel. When the steering ribbon 50 is locked in a position such that it occludes a portion of one of the slots 90, it causes the back axle 80 to become tilted when the vehicle moves forward and this alters the direction of travel of the vehicle. In this way the vehicle traces a pattern that covers the entire surface to be cleaned rather than moving back and forth over the same path.

Figure 8:
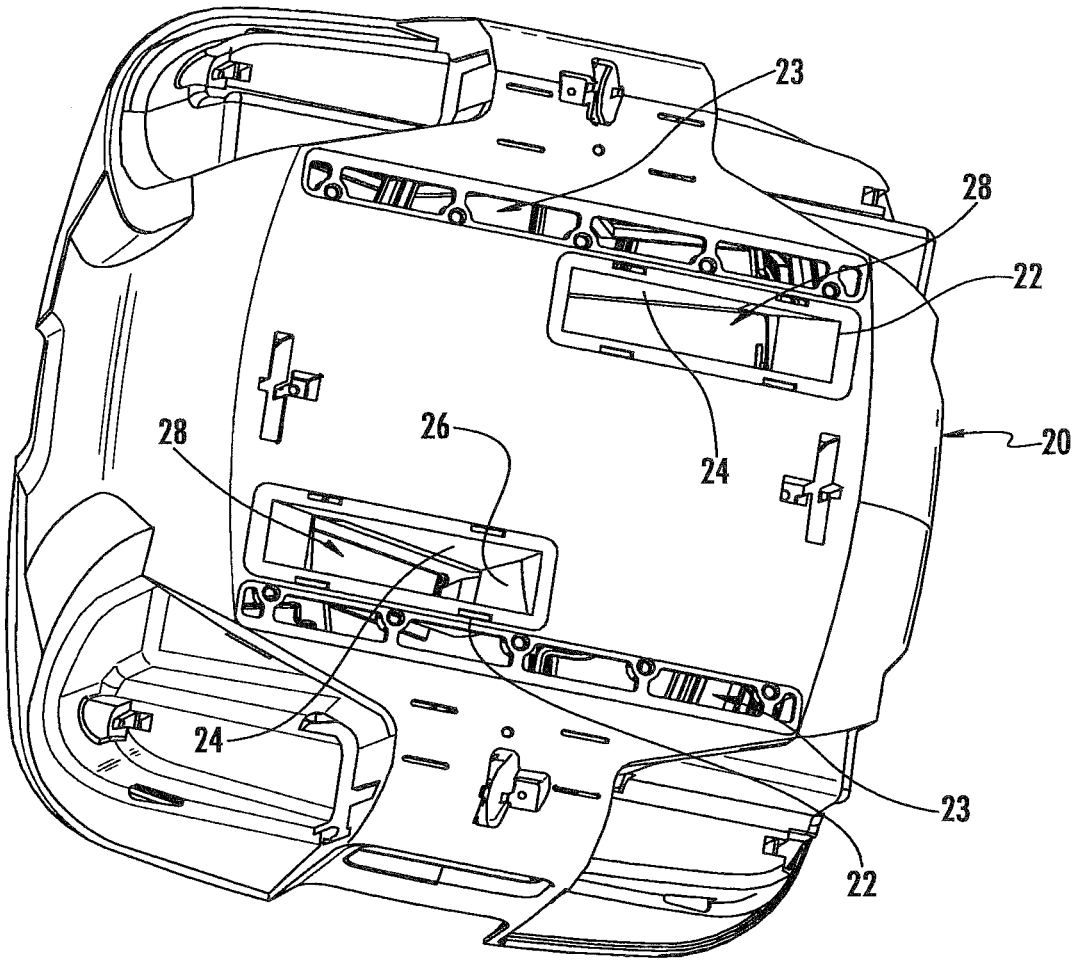
FIG. 8 is a perspective view of the bottom of the vehicle of FIG. 1.

Referring to FIG. 8 the bottom of the chassis 20 of the vehicle 10 is provided with inlet ports 22 which have side walls 24 and back walls 26, as well as flap valves 28. In one embodiment side walls 24 and back walls 26 extend from the bottom of the chassis 20 in a direction inwardly into the center of the vehicle 10. In an alternative embodiment, flap valves are attached directly to filter frame 110. Chassis 20 is provided with drainage slits 23 each of which has a flap valve 25. In operation the vehicle 10 is submerged beneath the surface of a liquid such as water which covers the surface which the vehicle is to clean such as the floor of a swimming pool. The interior of the vehicle is filled with this liquid as it is submerged. The propellers 14 shown in FIG. 1 then draw fluid in through the inlet ports 22 and expel it out of one of the outlet ports 15 shown in FIG. 1.

When the vehicle 10 has completed its cleaning operation it is raised out of the reservoir of liquid covering the surface being cleaned and the liquid contained within the vehicle is permitted to drain out through the drainage slits 23. The inlet port flap valves 28 allow liquid to be drawn into the interior of the vehicle 10 by the action of the propellers 14 but not to allow it to drain out. On the other hand, the drainage slit flap valves 25 allow the liquid to drain out of the interior of the vehicle 10 when it is raised out of the reservoir but prevents the entrance of the fluid into the interior through the drainage slits 23 when the vehicle is submerged and the propellers 14 are in operation.

Figure 9:
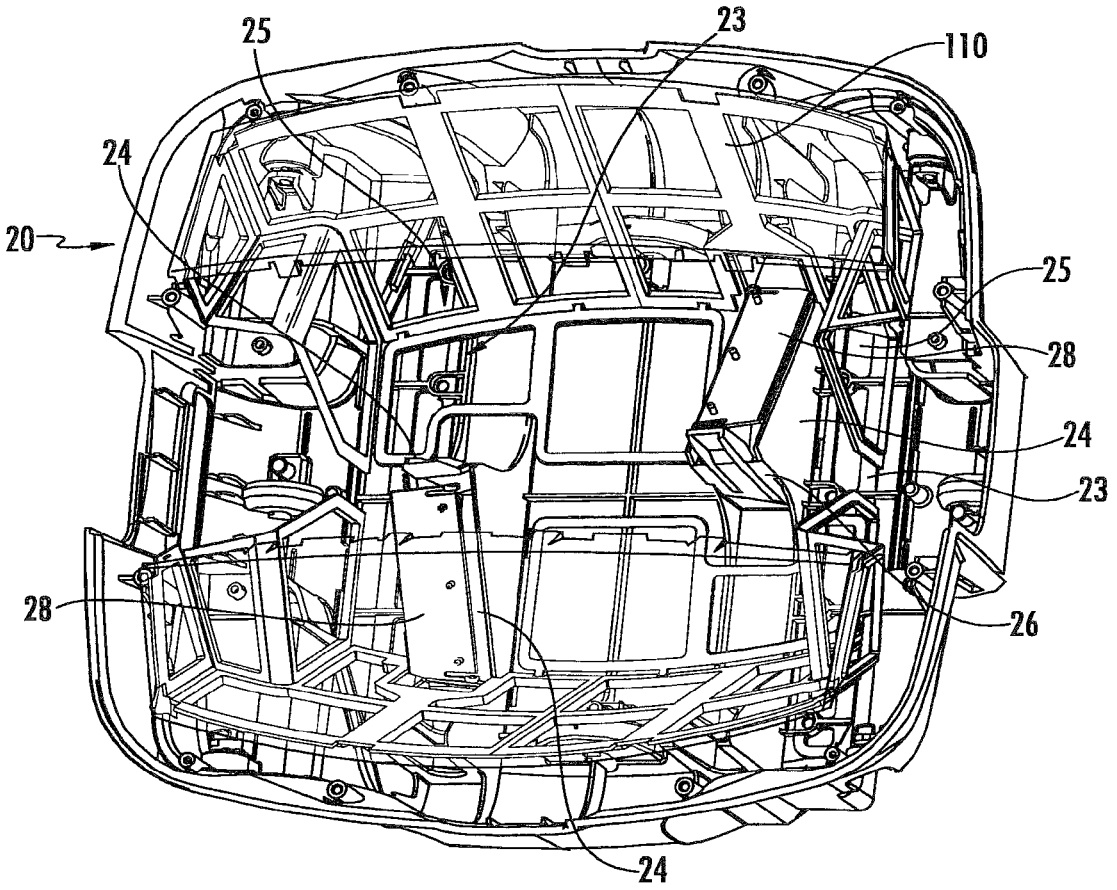
FIG. 9 is a perspective view of the inside of the vehicle of FIG. 1 with its filters illustrated.

Referring to FIG. 9 each of the inlet ports 22 opens into the interior of a filter frame 110 which is covered by a fine mesh material which serves to filter particulate impurities such as debris and bacteria out of the fluid which passes out of the interior of the filter frame 110. The inlet port flap valves 28 ensure that when the propellers 14 are not active fluid which has not yet passed through the fine mesh of the filter frame 110 does not drain back out of the vehicle 110. On the other hand, the drainage slits 23 are positioned outside the filter frame 110 and so only have access to fluid which has passed through the fine mesh of the filter frame 110.

The placement of the inlet ports 22 is to accommodate the filter system which in turn is configured to facilitate easy removal of the filter frame 110. The two inlet ports 22 are each placed on the opposite side of the centerline of the chassis 20 so that each can feed a separate filter frame 110 and yet the two together can cover the entire width of the chassis 20. The filter frames 110 are configured to be parallel to this center line so that they can be removed without interference with the electric motor 12 and its associated propellers 14.

Figure 10:
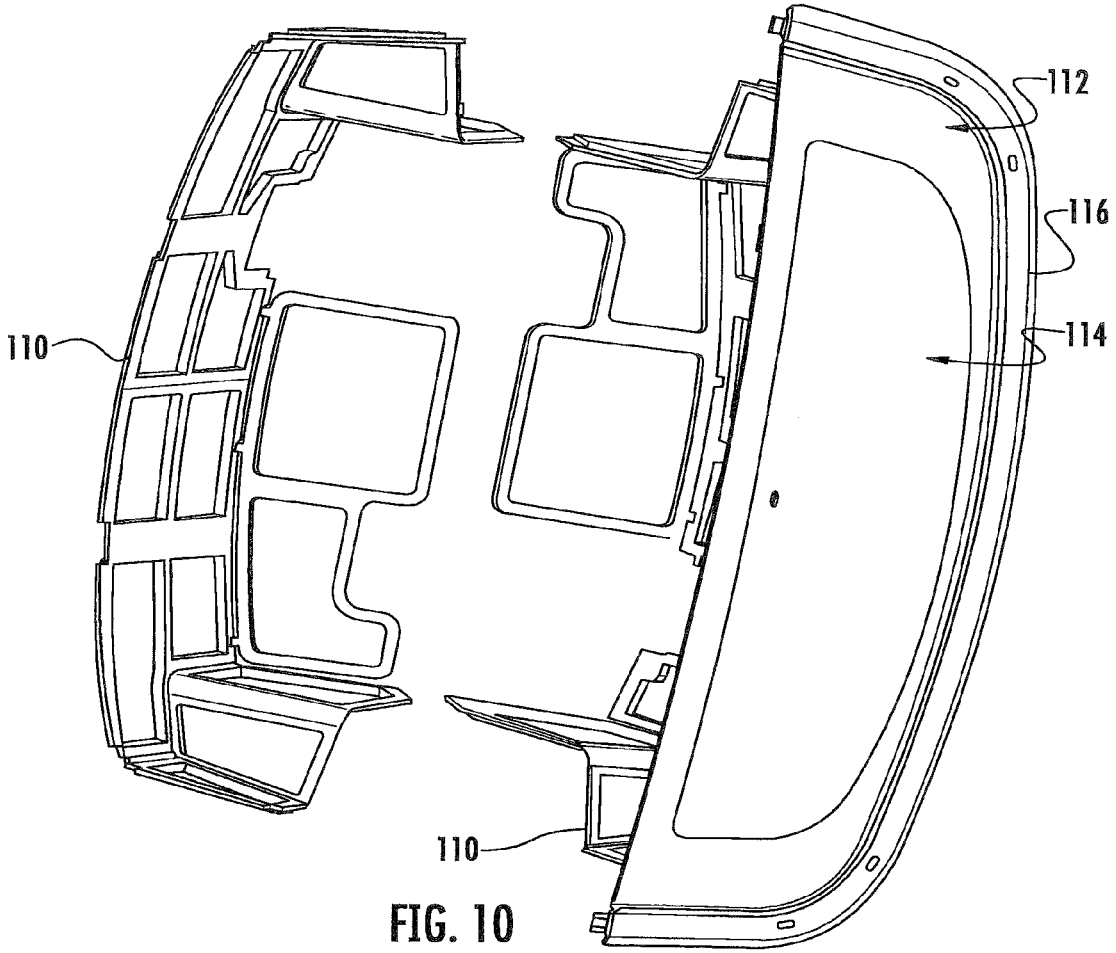
FIG. 10 is a perspective view of the filter assembly of the vehicle of FIG. 1.

Referring to FIG. 10 the filter system includes filter frame 110 which carries a fine mesh material and has a top 112, a window 114 and a handle 116. The window 114 may be transparent which allows the operator of the vehicle 10 to easily see what larger materials have accumulated in the filter frame 110 beneath that window 114 during the cleaning operation of the vehicle 110.

Figure 11:
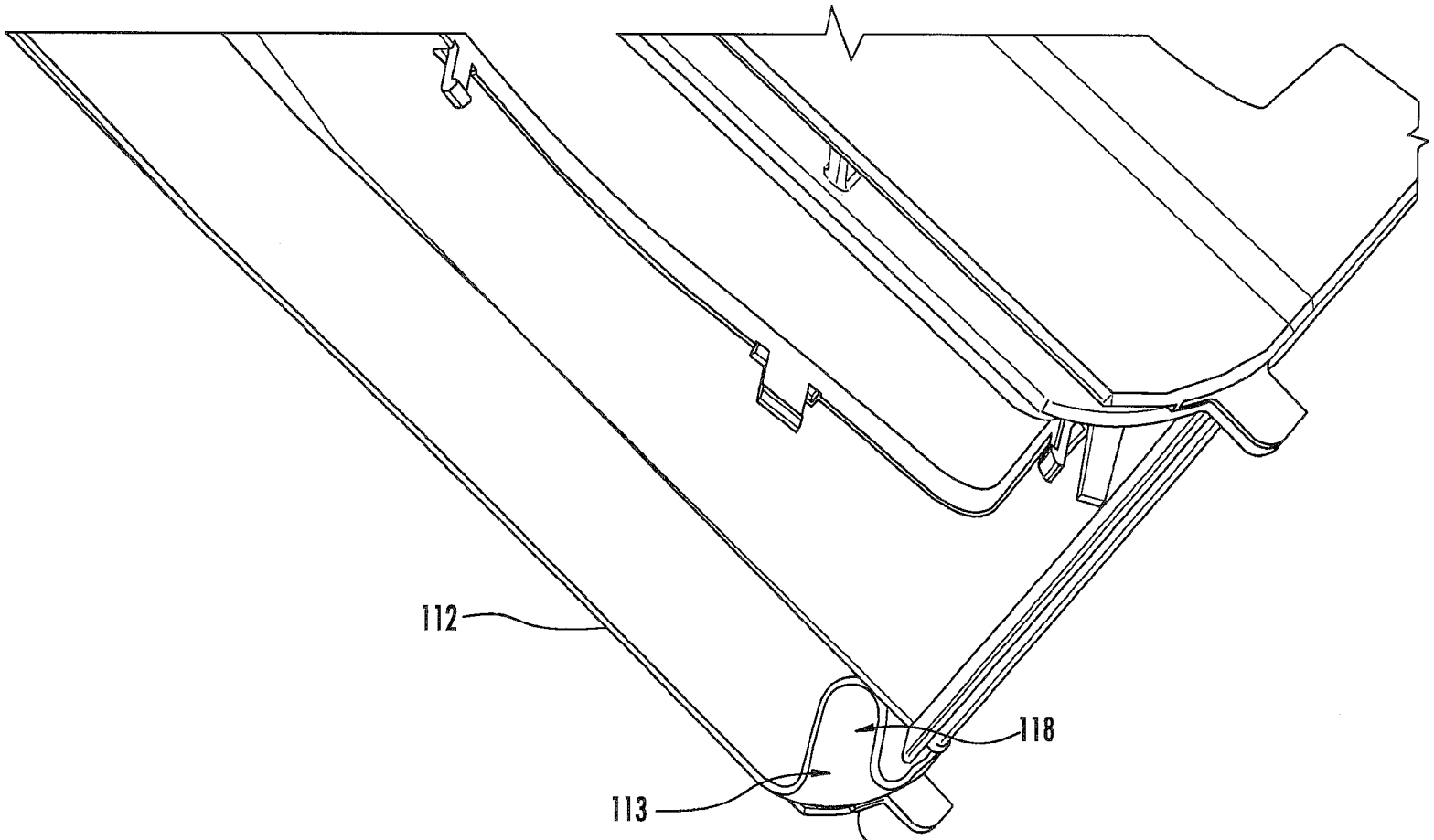
FIG. 11 is a perspective view of the mounting of the filter handle to the vehicle.
Figure 12:
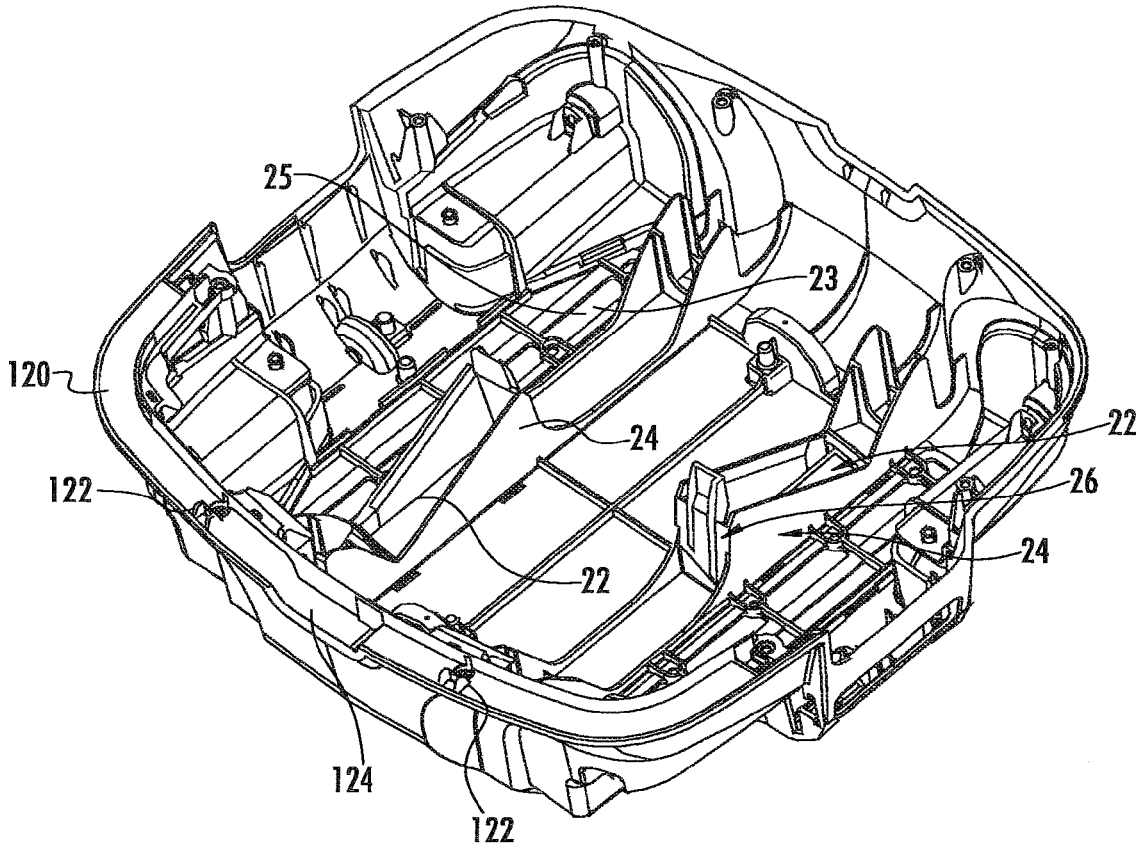
FIG. 12 is a perspective view of the inside of the vehicle showing the inlet ports.
Figure 13:
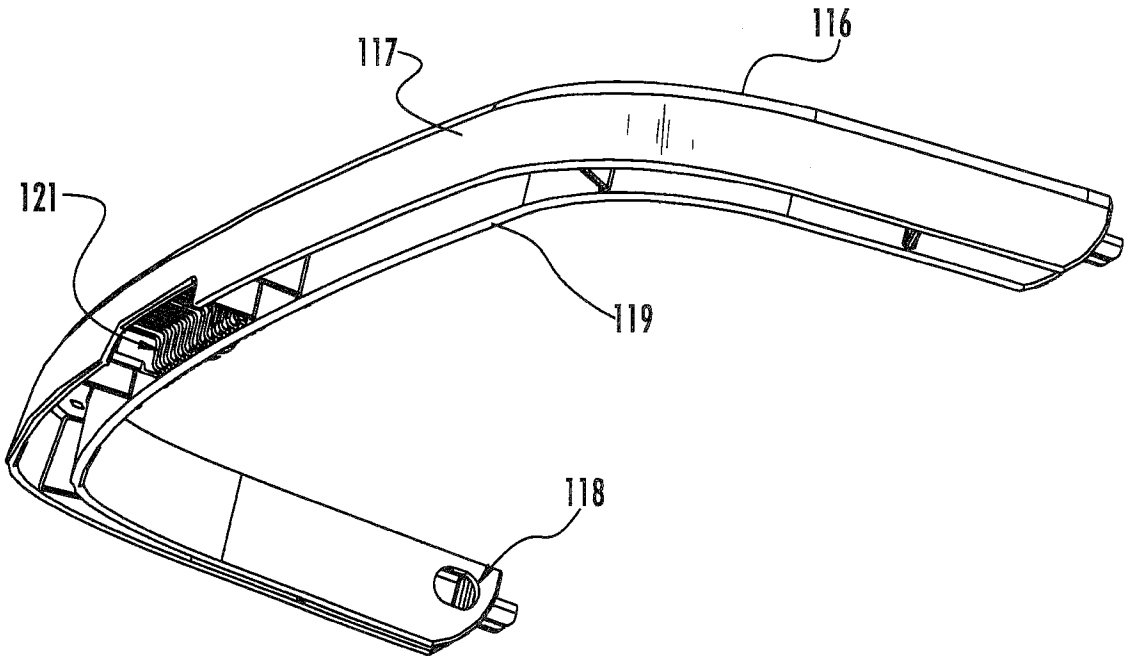
FIG. 13 is a perspective view of one of the filter handles of the vehicle of FIG. 1.
Figure 17:
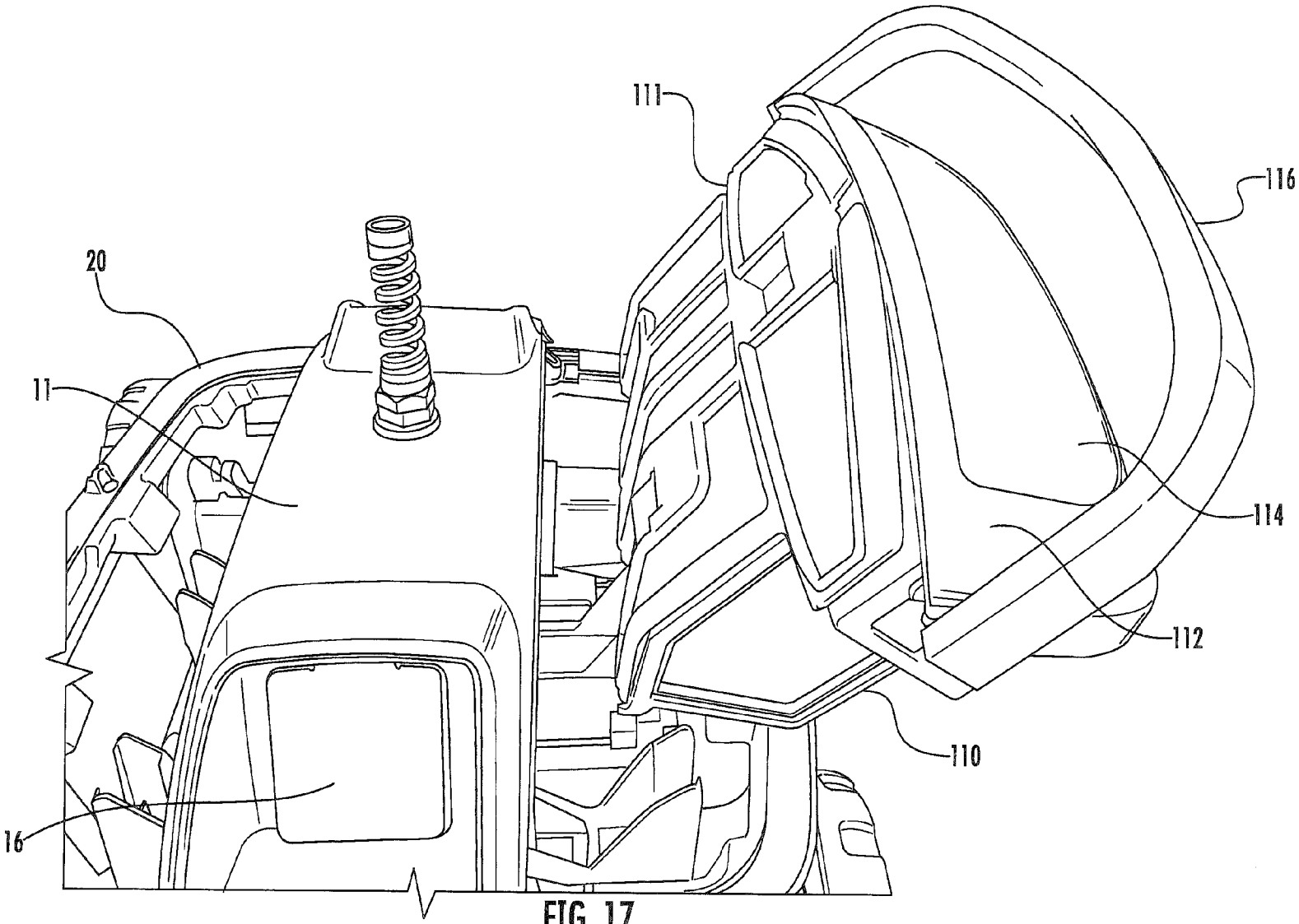
FIG. 17 is a perspective view of the filter assembly of the vehicle of FIG. 1 partially withdrawn from the vehicle.

The handle 116 provides for the removal of the filter frame 110 for cleaning but also provides a locking function for holding the filter frame 110 in place during the cleaning operation of the vehicle 10. This locking function is provided by the interaction of the protrusions 122 carried by the filter handle 120 as can be seen in FIG. 12 with the front wall 117 of the filter handle 116 which can be seen in FIG. 13. The filter handle 116 is constructed as a downward facing u channel with a back wall 119 as well as the front wall 117. The protrusions 122 fit between these walls in frictional engagement with the front wall 117 to lock the filter frame 110 in place during the cleaning operation of the vehicle 110. The handle 116 also carries a depression 121 which facilitates grasping the handle 110 and raising it out of a locked position. This depression 121 mates with a depression 124 in the filter trim 120 shown in FIG. 12 to allow easy grasping access to the locked in position filter handle 116. The handle 116 also carries a shaped boss 118 which mates with a shaped hole 113 in the filter frame top 112 as seen in FIG. 11 such that the upward rotation of the handle is restrained once it reaches the appropriate angle for withdrawal of the filter frame 110 from the chassis 20. A partial withdrawal at this appropriate angle up and to the side of the centerline of the chassis 20 is shown in FIG. 17.

Figure 14:
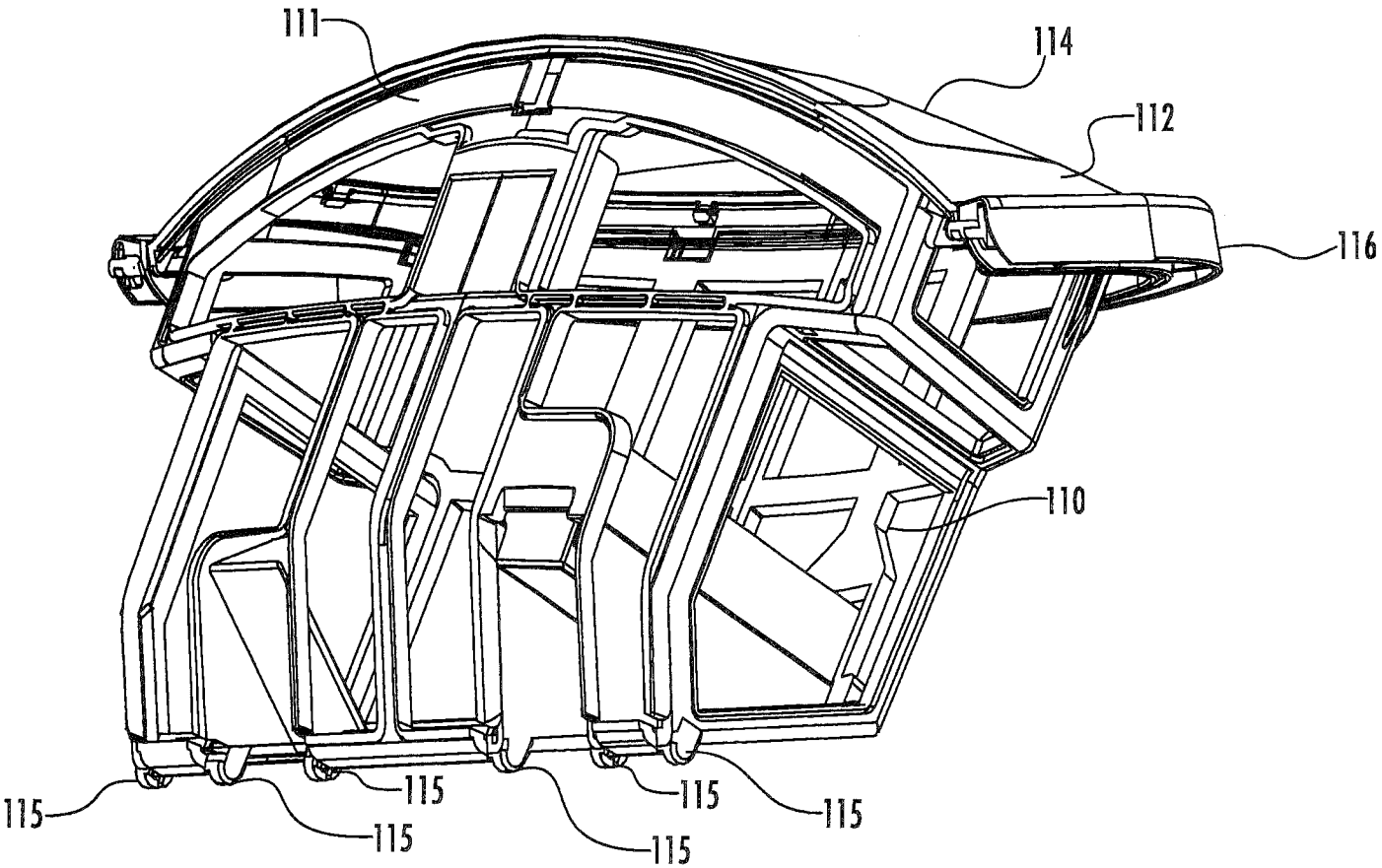
FIG. 14 is a perspective view of the filter assembly of the vehicle of FIG. 1 with its hinges shown.

The filter frame 110 is also provided with a door 111 which opens on hinges 115 as can be seen in FIG. 14. This allows access to the interior of the filter frame 110 for the removal of debris which has accumulated during the cleaning operation of the vehicle 10. This provides for an easy method for cleaning the filtering system.

Figure 15:
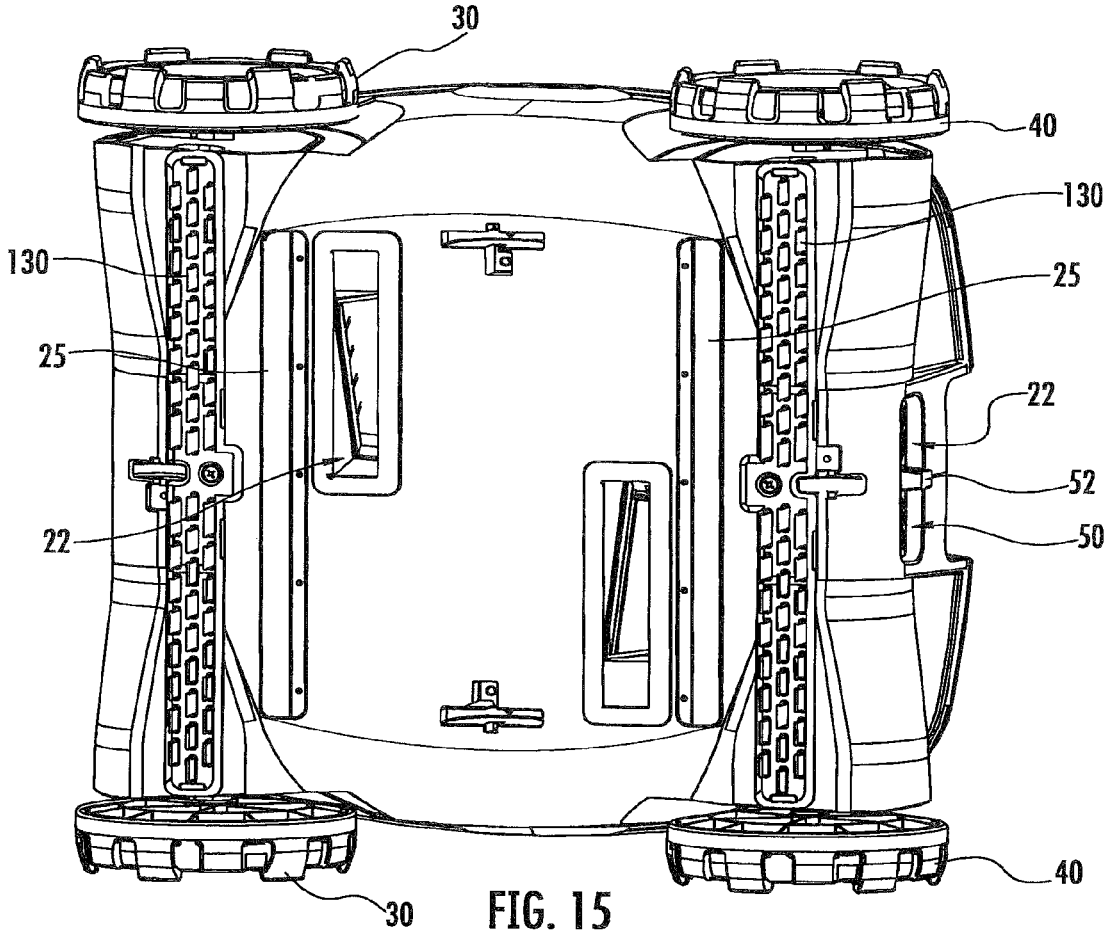
FIG. 15 is a perspective view of the bottom of the vehicle of FIG. 1 with its passive brushes illustrated.
Figure 16:
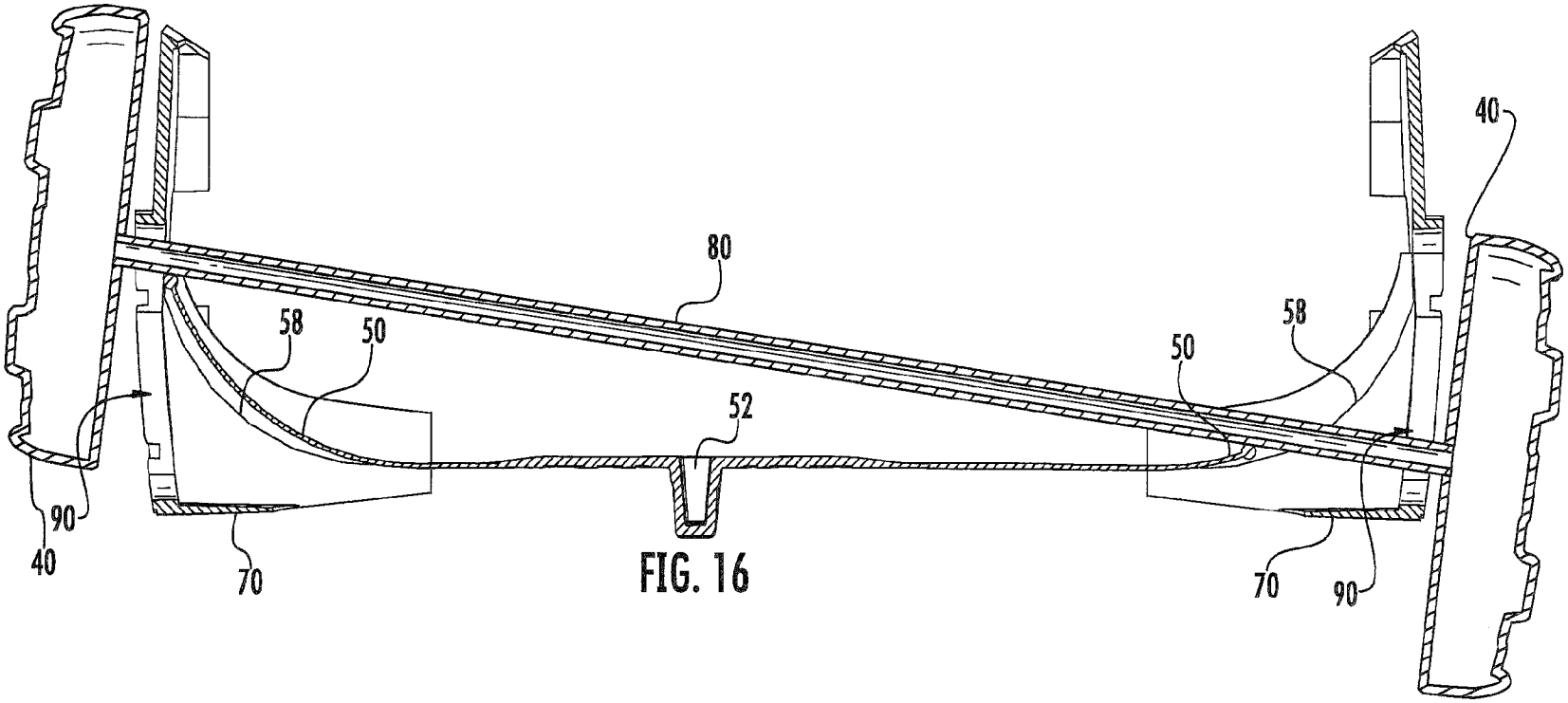
FIG. 16 is a cross section along line 16-16 of FIG. 6.

The bottom of the chassis has been provided with passive brushes 130 which can be seen in FIGS. 1 & 15. As shown each brush extends across the full width of the chassis 20. However, if the inlet ports 22 were moved closer to the leading and trailing ends of the chassis 20 each passive brush could be shortened such that it just extended across a portion of the width. But in one such embodiment the passive brushes 130 would be mounted such that they jointly covered the entire width of the chassis. Each passive brush 130 is constructed of scrubbing elements which reach to the surface to be cleaned when the chassis 20 is supported on this surface by its front wheels 30 and its rear wheels 40. In one embodiment the scrubbing elements are stiff bristles.

Figure 18:
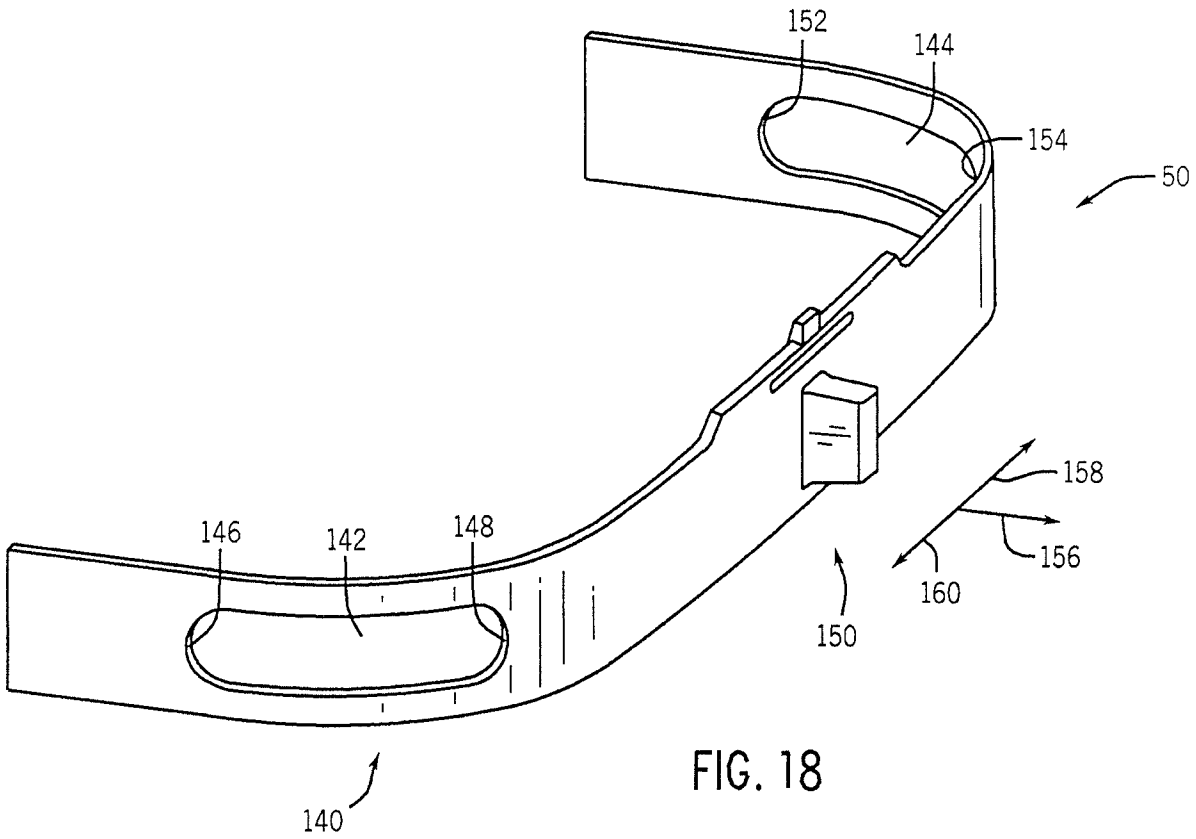
FIG. 18 is a perspective view of a flexible ribbon with slots.

In another embodiment, shown in FIG. 18, steering member or flexible ribbon 50 includes a connecting member 140 that operatively engages axle 80. In one implementation connecting member 140 includes a first slot 142 and a second slot 144. Axle 80 extends through first slot 142 and second slot 144. First slot 142 includes a first end 146 and a second end 148, the second end 148 being closer to center section 150 than first end 146. Similarly, second slot 144 includes a first end 152 and a second end 154, where second end 154 is closer to center section 150 than first end 152. Note that first slot 142 and second slot 144 have a longitudinal axis defined between first and second ends of each slot. First slot 142 and second slot 144 are in a non linear alignment with center portion 150. Since ribbon 50 is flexible, the shape of the region of the ribbon adjacent the slots 142, 144 may vary as ribbon 50 is moved from one position to another position to adjust the axle angle relative to the body as described above.

In a center setting where knob 52 is positioned midway or equidistant between the wheels 40 attached to axle 80, axle 80 will be perpendicular to the movement of the vehicle when the vehicle moves in a direction toward slide knob 52 as shown by vector 156. When the vehicle is moving in the direction of vector 156 axle 80 will be pushed by and adjacent to first ends 146 and 152 of first and second slots 142 and 144 respectively. Similarly, when the vehicle moves rearward in a direction opposite vector 156, axle 80 remains perpendicular to vector 156 with axle 80 being pushed by and adjacent to second ends 148 and 154 of first and second slots 142 and 144 respectively.

When a user moves slide knob 52 to a rightward position in vector direction 158, first end 146 of first slot 142 will pull axle 80 proximate slot 142 in vector direction 156. However, the portion of axle 80 proximate second slot 144 will be free to travel between first end 152 and second end 154 of second slot 144. In this configuration, when the vehicle is moving in vector direction 156, the axle 80 proximate first slot 142 will be in a fixed/restrained mode while the axle 80 proximate second slot 144 will have freedom to move toward the body opposite vector 156 such that axle 80 proximate second slot 144 will be adjacent first end 152 of second slot 144. As a result, the axle and wheels will be at a non-perpendicular angle relative to vector 156. This will result in the vehicle being steered or directed in a leftward motion with respect to vector 156. For purposes of clarity, the vector direction that the vehicle will move in this mode will be between vectors 156 and 158.

In this rightward mode when the vehicle is moved in a direction opposite to vector 156 axle 80 proximate first slot 142 will remain fixed relative to first end 146 of first slot 142 while the axle will be pushed to second end 154 of second slot 144. Hence making the axle perpendicular to vector 156. As a result the motion of the vehicle in the direction opposite to vector 156 will be straight, while the motion of the vehicle in the general direction of vector 156 will veer in a left ward direction between vectors 156 and 158 as noted above.

When a user moves slide knob 52 to a leftward position opposite to vector direction 158, first end 152 of second slot 144 will pull axle 80 proximate slot 144 in vector direction 156. However, the portion of axle 80 proximate first slot 142 will be free to travel between first end 146 and second end 148 of first slot 142. In this configuration, when the vehicle is moving in vector direction 156, the axle 80 proximate second slot 144 will be in a fixed/restrained mode while the axle 80 proximate first slot 142 will have freedom to move toward the body opposite vector 156 such that axle 80 proximate first slot 144 will be adjacent first end 146 of first slot 142. As a result, the axle and wheels will be at a non-perpendicular angle relative to vector 156. This will result in the vehicle being steered or directed in a rightward motion with respect to vector 156. For purposes of clarity, the vector direction that the vehicle will move in this mode will be between vectors 156 and 160.

In this leftward mode when the vehicle is moved in a direction opposite to vector 156 axle 80 proximate second slot 144 will remain fixed relative to first end 152 of second slot 144 while the axle 80 proximate first slot 142 will be pushed to second end 148 of first slot 142. Hence making the axle 80 perpendicular to vector 156. As a result the motion of the vehicle in the direction opposite to vector 156 will be straight, while the motion of the vehicle in the general direction of vector 156 will veer in a right ward direction between vectors 156 and 160 as noted above.

While only certain features of the invention have been illustrated and described herein, many modifications and changes will occur to those skilled in the art. It is, therefore, to be understood that the appended claims are intended to cover all such modifications and changes as fall within the true spirit of the invention. It is noted that the construction and arrangement of the pool cleaning vehicle with mechanism for skewing an axle as described herein is illustrative only. Although only a few embodiments of the present invention have been described in detail in this disclosure, those skilled in the art who review this disclosure will readily appreciate that many modifications are possible (e.g. variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements and vice versa, the position of elements may be reversed or otherwise varied, and the nature of number of discrete elements or positions may be altered or varied. Additionally, the mechanism for skewing the axle may also be applied to other pool cleaning vehicles including vehicles with wheels driven by a mechanical linkage to a motor, or to vehicles employing a single propeller. Accordingly, all such modifications are intended to be included within the scope of the present invention to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the exemplary embodiments without departing from the scope of the present inventions as expressed in the appended claims.

What is claimed is:

1. A method for cleaning a pool with a pool cleaner comprising:

providing a pool cleaner having a hollow body including a longitudinal axis, an inlet and an outlet, a filter within the body between the inlet and the outlet, a drive mechanism mounted to the body for moving the cleaner on a surface of the pool, a first axle end extending generally normal to the longitudinal axis and having a first support rotatably mounted thereon for supporting and guiding the cleaner on the surface of the pool, the first axle end extending through a corresponding first elongated slot that is formed at a first side of the body, and a flexible steering ribbon slidably mounted in a guide track formed in the body; and positioning the flexible steering ribbon in the guide track to selectively occlude a portion of the first elongated slot and skew the first axle with respect to the longitudinal axis of the pool cleaner.

2. The process of claim 1, further comprising the steps of initiating the drive mechanism to move the cleaner on a submerged surface of the pool; and cleaning the submerged surface of the pool such that the cleaner movement veers laterally with respect to the longitudinal axis.

3. The process of claim 1, further comprising the step of locking the flexible steering ribbon at a selected position along the guide track.

4. The process of claim 1, wherein the step of positioning the flexible steering ribbon comprises moving an end of the steering ribbon to occlude the portion of the first elongated slot.

5. The process of claim 1, further comprising the step of mounting the steering ribbon at a rear portion of the body.

6. The process of claim 1, further comprising the step of providing a second axle end extending generally normal to the longitudinal axis and having a second support rotatably mounted thereon for supporting and guiding the cleaner on the surface of the pool, the second axle end extending though a corresponding second elongated slot that is formed at a second side of the body.

7. The process of claim 6 further comprising positioning the flexible steering ribbon in the guide track to selectively occlude a portion of the second elongated slot to control movement of the second axle end therein.

8. The process of claim 6, wherein said providing a second axle end further comprises the step of providing a single axle having said first and second axle ends and that extends generally normal to the longitudinal axis.

9. The process of claim 1, further comprising:

providing a first ribbon slot in a portion of said steering ribbon proximate to said first elongated slot and extending said first axle end through said first ribbon slot and said first elongated slot; and moving the steering ribbon to selectively position the first ribbon slot relative to the first elongated slot to control movement of said first axle end.

10. The process of claim 6, further comprising:

providing first and second ribbon slots in corresponding portions of said steering ribbon proximate to said respective first and second elongated slots and extending said first and second axle ends respectively through said first and second ribbon slots and said first and second elongated slots; and moving the steering ribbon to selectively position the first and second ribbon slots relative to the corresponding first and second elongated slots to control movement of said first and second axle ends.

11. The process of claim 1, further comprising the step of providing a third axle end extending generally normal to the longitudinal axis and having a third support rotatably mounted thereon for supporting and guiding the cleaner on the surface of the pool, the third axle end extending distally away from the first axle end on the first side of the body.

12. The process of claim 11, further comprising the step of providing a fourth axle end extending generally normal to the longitudinal axis and having a fourth support rotatably mounted thereon for supporting and guiding the cleaner on the surface of the pool, the fourth axle end extending distally away from the second axle end on the second side of the body.

13. The process of claim 12, wherein said providing said third and fourth axle ends further comprises the step of providing a single axle having said third and fourth axle ends and that extends generally normal to the longitudinal axis.

* * * * *